United States Patent [19]

Seki et al.

[11] Patent Number: 4,773,963

[45] Date of Patent: Sep. 27, 1988

[54] SINGLE FACER WITH REPLACABLE ROLLERS

[75] Inventors: Yukuharu Seki; Hiroaki Sasashige, both of Hiroshima, Japan

[73] Assignee: Mitsubishi Jukogyo Kabushiki Kaisha, Tokyo, Japan

[21] Appl. No.: 102,365

[22] Filed: Sep. 29, 1987

[30] Foreign Application Priority Data

Mar. 30, 1987 [JP] Japan ..... 62-77363

[51] Int. Cl.[4] ..... B31L 1/24

[52] U.S. Cl. ..... 156/470; 156/205; 156/471; 425/369

[58] Field of Search ..... 156/470, 471, 472, 473, 156/555, 582; 248/652, 666; 264/369; 100/47, 168

[56] References Cited

U.S. PATENT DOCUMENTS 3,707,909 1/1973 Volkers ..... 156/473
4,620,896 11/1986 Sueki et al. ..... 156/578
4,627,831 12/1986 Hiragawa et al. ..... 156/472
4,629,526 12/1986 Kanda ..... 156/210
4,631,109 12/1986 Hirakawa et al. ..... 156/472
4,642,087 2/1987 Hoffman ..... 156/205
4,643,706 2/1987 Wetterling ..... 156/472

*Primary Examiner*—Michael Wityshyn
*Attorney, Agent, or Firm*—Bernard, Rothwell & Brown

[57] ABSTRACT

A single facer comprising a pair of upper and lower corrugating rolls having a corrugation thereon for corrugating a core sheet fed therebetween. The sheet is then pasted at the tops of their corrugations. A liner is fed in different direction and caused to pass together with the pasted sheet between the lower corrugating roll and a pressure roll to be sticked to each other to thereby form a single-sided corrugated sheet. The upper and lower corrugating rolls are supported by separate rotatable frames, and engageable with each other to form a corrugation forming unit. A plurality of corrugation rolls having a different corrugation shape thereon are provided on each of the rotatable frames.

4 Claims, 4 Drawing Sheets

SINGLE FACER WITH REPLACABLE ROLLERS

BACKGROUND OF THE INVENTION

This invention relates to a single facer of a corrugating machine which manufactures a single-sided corrugated sheet.

A conventional single facer is shown in FIG. 5 in which a core sheet 1 is fed to the bite of an upper roll 3 and a lower roll 4, each having a corrugated surface, to thereby be corrugated. At the next process, a pasting roll 5 applies a paste 9 to the tops of the corrugations on the core. The corrugated sheet 1 is caused to pass through the bite of the lower roll 4 and a pressure roll 7 together with a liner 6 fed in a different direction under pressed condition to thereby be sticked together. Thus a single-sided corrugated sheet 8 is continuously manufactured. In order to expedite the shaping of the sheet 1 and the sticking by paste 9, steam is introduced into the rolls 3, 4 and 7 to keep same under high temperature. The resulting corrugated cardboard sheet may have one of flutes A, B, C, E which differ in height and corrugation pitch and which is selected in accordance with the purpose of use. However, the kinds of flutes manufactured by a single single-facer of the conventional system are usually one and if a flute is especially to be changed, it is necessary to perform complicated operations such as exchange of the core corrugating means, namely, corrugating rolls 3 and 4, which is time consuming.

Namely, when the corrugating rolls are to be exchanged, it is necessary to disassemble a bracket 36, a pivot pin 37, an arm 38, and parts related to the mounting of the upper and lower rolls 3 and 4 and also to disassemble steam piping or the like. Another problem is that one must wait until the corrugating rolls and peripheral parts which are heated to a high temperature due to the steam introduced to expedite the shaping of the sheet 1 and the sticking by paste 9 during operation are cooled to a low temperature. Therefore, it will take at least one day or two for exchange of the parts. Due to these drawbacks, the conventional single facer is, in fact, used exclusively for manufacturing substantially one limited kind of a flute. Today, there are various kinds of corrugated cardboards due to customers' various needs. It is desired to easily manufacture several kinds of single-sided corrugated sheets of flutes using a single single-facer.

In order to solve this problem, Laid-Open Patent and Utility-Model Application Nos. 104325/1985 and 18818/1986, respectively, propose some devices. FIG. 6 shows the latter which will now be described. This device has a rotating frame 38 on which two sets of corrugating units in different in corrugation shape, namely, a pair of upper and lower rolls 3 and 4 and another pair of upper and lower rolls 3' and 4' are mounted. The rotation of the frame 38 around a central shaft 39 allows exchange one pair of corrugating rolls with another pair of corrugating rolls having a different corrugation shape.

There are kinds of A, B, C and E flutes in corrugated cardboard sheets depending on the shape (height and pitch) of the corrugations thereof. When a corrugation cardboard sheet having a different flute is manufactured using a single-facer, it is necessary to together exchange a pair of corrugating rolls, which forms a corrugation, with another pair. When the conventional corrugating rolls are to be exchanged, however, it is necessary to disassemble the bracket 36, pivot pin 37 and steam piping as shown in FIG. 5. In addition, another condition is that one wait until the corrugating rolls and peripheral parts which are heated to a temperature higher than that of the steam introduced during operation are cooled to a lower temperature, so that it takes one day or two for exchange, inclusive of the waiting time. Due to this time loss, in fact a single single-facer usually can manufacture only one kind of a corrugated cardboard sheet.

In order to solve this problem, a device shown in FIG. 6 is proposed which has a structure in which sets of upper and lower corrugating rolls different in corrugation shape are mounted on the same rotating frame. When an order is changed, the rotating frame will be rotated with unprocessed paper (core paper) being kept between the upper and lower rolls, so that it is inevitable to cut away the core sheet in advance, to exchange the upper and lower corrugating rolls, and then to perform work involving setting a sheet of paper. This invention is proposed to solve such problems.

SUMMARY OF THE INVENTION

According to this invention, a plurality of upper corrugating rolls different in corrugation shape and a like number of lower corrugating rolls are supported on different rotating frames which are rotated to cause the corresponding upper and lower rolls to engage each other to constitute a pair of designated waveform forming units.

Thus, several kinds of corrugated cardboard sheets different in corrugation shape can be produced as needed any time. In addition, the upper and lower corrugating rolls are constituted as separate units, so that a change of a flute following a change of an order can be continuously performed without cutting away the core paper and liner.

BRIEF DESCRIPTION OF THE DRAWINGS

FIG. 1 is a front cross-sectional view roughly showing the entire structure of the embodiment.

FIG. 2 is a cross-sectional view taken along the line A—A of FIG. 1.

FIG. 3 is a cross-sectional view taken along the line B—B of FIG. 1.

FIG. 4 is a cross-sectional view taken along the line C—C of FIG. 1.

DETAILED DESCRIPTION

Figure 1:
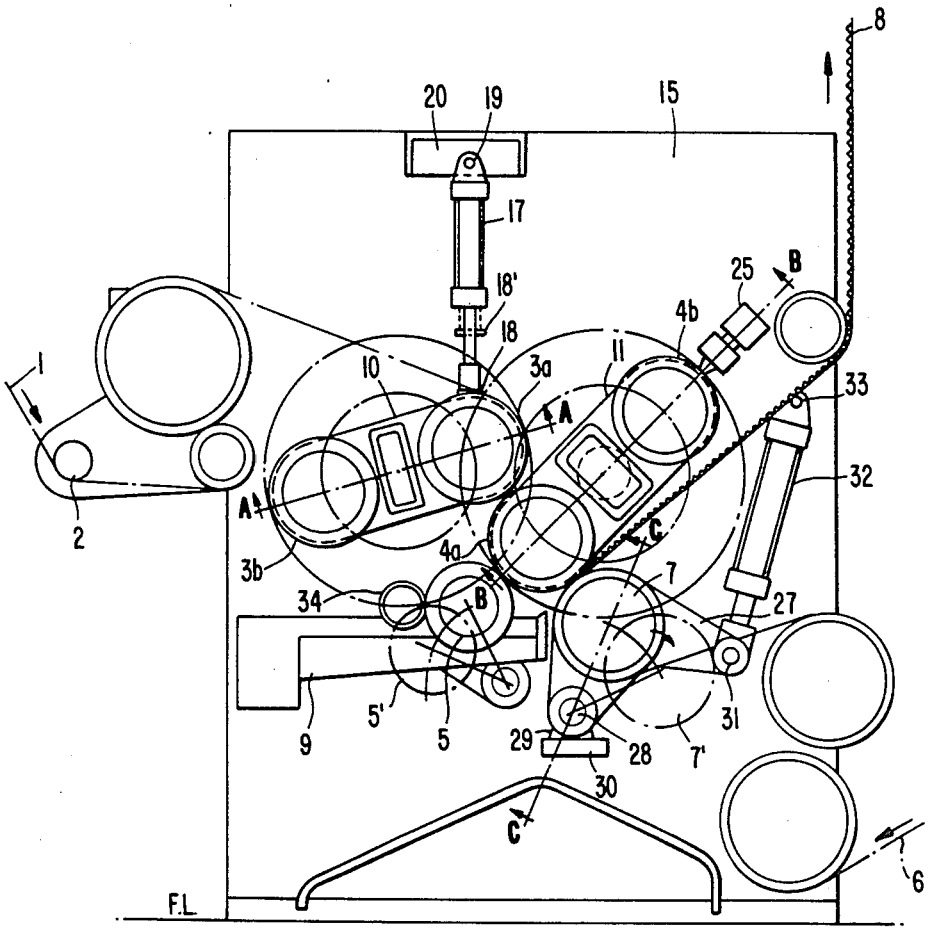
FIGS. 1–4 show one embodiment of this invention.
Figure 2:
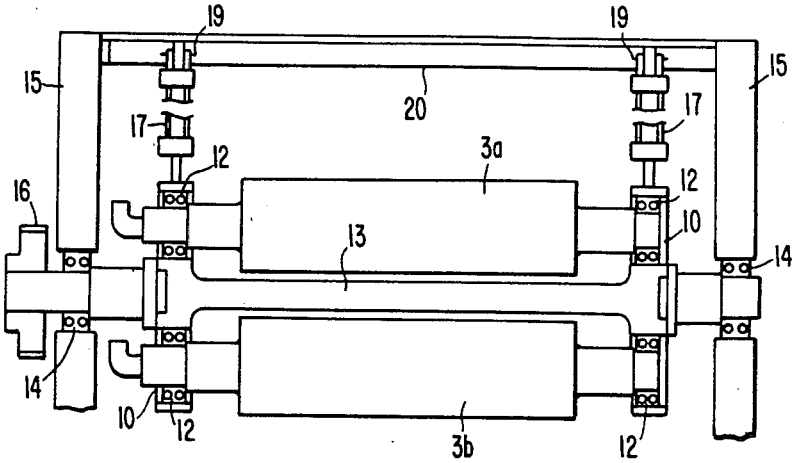
Figure 3:
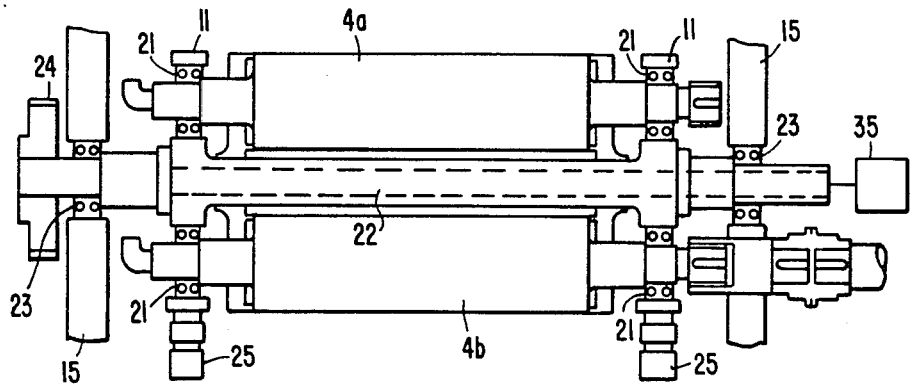

This invention will now be described in more detail using a preferred embodiment thereof shown in FIGS. 1–4. The entire function of this embodiment is substantially the same as that of the conventional single facer. As shown in FIG. 1, a core sheet 1 is fed via a guide roll 2 to the bite of an upper roll **3*a* and a lower roll 4*a*, each having a corrugated surface, to thereby be corrugated. At the next process, a pasting roll 5 applies a paste 9 to the tops of the corrugations on the core. The corrugated sheet 1 is caused to pass through the bite of the lower roll 4 and a pressure roll 7 together with a liner 6 fed in a different direction under pressed condition to thereby be sticked together. Thus a single-sided corrugated sheet 8 is continuously manufactured. In order to expedite the shaping of the sheet 1 and the sticking by paste 9, steam is introduced into the rolls 3***a*, 4*a* and 7 to keep same under high temperature. The upper corrugating rolls 3*a*, 3*b* and lower corrugating rolls 4*a*, 4*b* which form corrugations on the core sheet 1 are supported on separate rotatable frames 10 and 11, respectively. By engaging the corresponding corrugating rolls with each other, a pair of corrugating rolls units is constituted.

While in the particular embodiment two sets of upper and lower corrugating rolls 3 and 4 are shown as being provided, it is possible to form many flutes by provision of three or more sets of upper and lower corrugating rolls. The two sets of upper corrugating rolls 3*a* and 3*b* different in corrugation shape on their outer surfaces are supported at their shaft ends by bearings 12 on frame 10 which is rotatable together with its center shaft 13 fixed thereto. The shaft 13 is supported at their ends by bearings 14 on a side frame 15 and has a gear 16 fixed to one end thereof.

A cylinder 17 pushes the frame 10 end by its head 18 to thereby move the upper roll 8*a* downwardly so as to control the contact pressure on the lower corrugating roll 4*a*. A bracket mounting the cylinder 17 is fixed to a side frame 15 via a pin 19 and a beam 20.

Two sets of lower corrugating rolls 4*a* and 4*b* different in corrugation shape are supported via bearings 21 on the frame 11 which can rotate together with its central shaft 22 fixed thereto. Shaft 22 is supported at each end via a bearing 23 to the side frame 15, and has a gear 24 fixed to one end thereof and coupled at the other end to a drive device 35 such as a motor.

The gear 24 meshes with the gear 16 and has the same number of teeth as the gear 16. Therefore, the relative positional relationship between the upper and lower corrugating rolls is always maintained. A stop 25 is provided on the side frame 15 over the frame 11 so as to steadily stop the lower corrugating roll to be set when same comes to a predetermined position.

Figure 4:
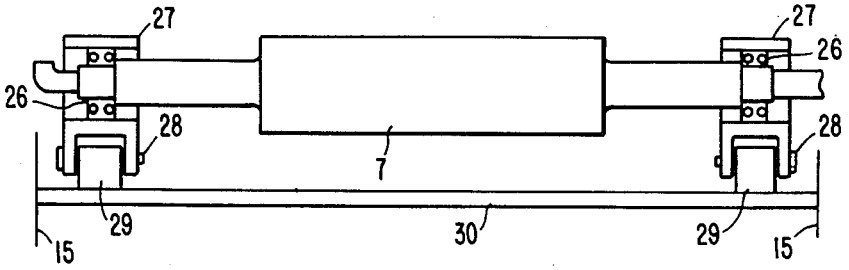
Figure 5:
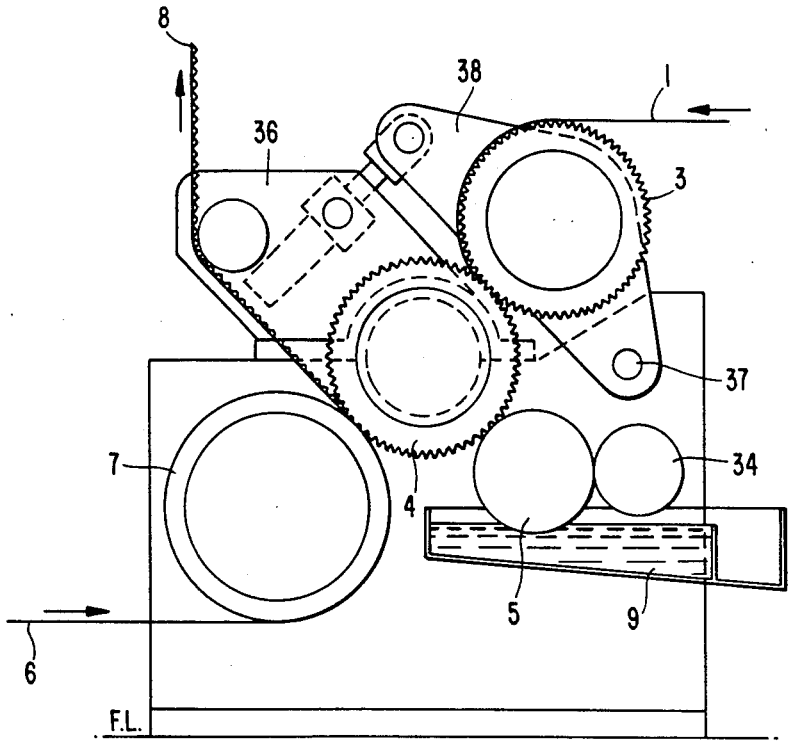
FIG. 5 is a front cross-sectional view showing the rough structure of a conventional single facer.
Figure 6:
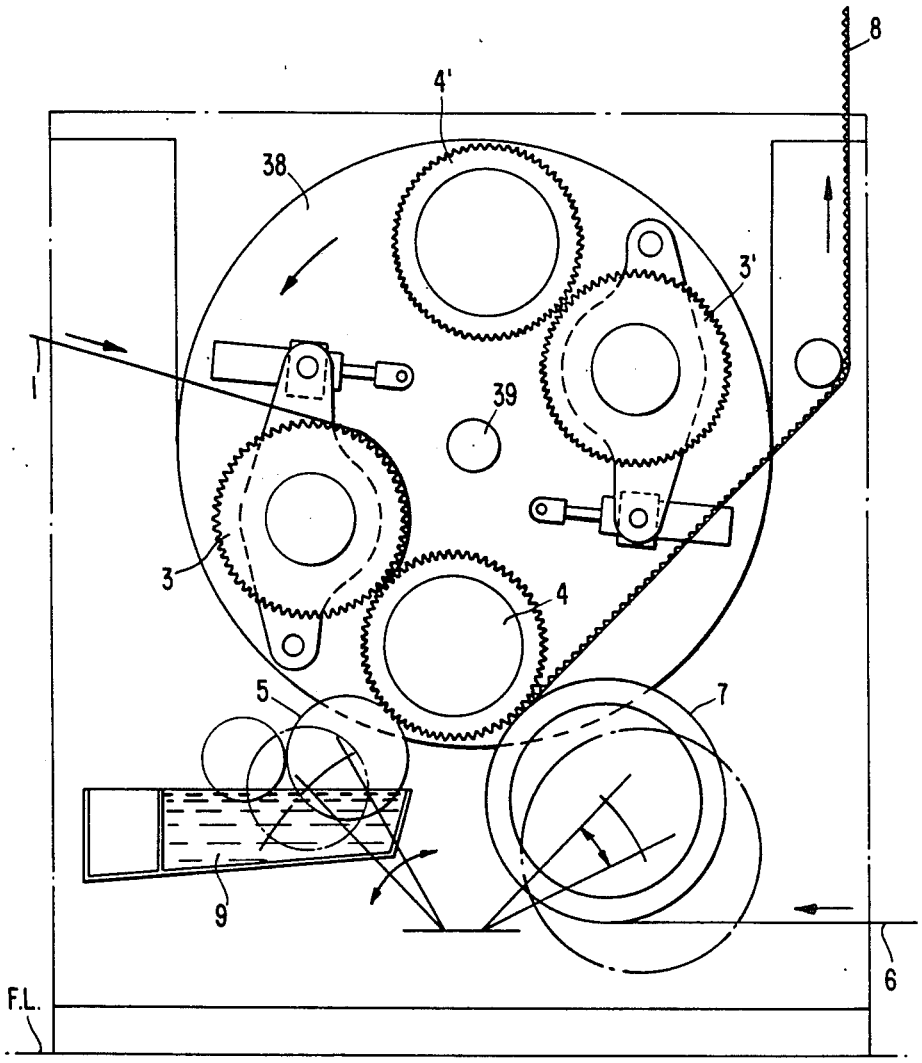
FIG. 6 is a front cross-sectional view showing the rough structure of another conventional single facer.

The pressure roll 7 is supported via a bearing 26 at each end to a corresponding arm 27 as shown in FIGS. 1 and 4. The arm 27 is supported on the side frames 15 via pins 28, brackets 29 and a stay 30. The head of a cylinder 32 is mounted at the other end of the arm 27 via a pin 31 and a mounting bracket for cylinder 32 is supported by the side frame 15 via a pin 33. Therefore, the operation of the cylinder 32 can move the pressure roll 7 to a position shown by the two-dot chain line around the pin 28. The pasting roll 5 may also be moved downwardly as shown by the two-dot chain line by an oscillating device, not shown. Reference numeral 34 denotes a doctor roll which controlls a quantity of paste transferred.

In operation, a change of a flute following a change of an order (exchange of corrugating rolls) will be performed as follows. First, the head 18 of the cylinder 17 is retracted to the position 18' shown by the two dot chain line, the pasting roll 5 and pressure roll 7 are moved to positions 5' and 7', respectively, shown by the two-dot chain lines, and the stop 25 is released. The shaft 22 is then rotated to counter-clockwise direction in FIG. 1 by the drive device 35 such as a motor. This causes the shaft 13 to rotate reversely via the gears 16 and 24.

When the frame 11 is rotated by a half counterclockwise rotation and the lower roll 4*b* comes to a predetermined position, the rotation of the shaft 22 is stopped and the stop 25 fixes the shaft 22 reliably. At this time, the frame 10 also rotates by a half clockwise rotation, and the upper roll 3*b* is rotated to a position corresponding to the lower corrugating roll 4*b* whereupon it stops.

Then, the cylinder 17, pasting roll 5 and press roll 7 are returned to their original positions. By the above operation, exchange of one upper corrugating roll 3*a* with another 3*b* and of one lower corrugating roll 4*a* with another 4*b* is completed to thereby allow a corrugated cardboard sheet having a different flute to be continuously manufactured.

It is to be noted that the processes for driving the lower corrugating rolls and for introducing steam into the rolls are similar to those employed in the prior art ones.

According to this invention, the frame on which a plurality of upper corrugating rolls is supported and the frame on which a plurality of lower corrugating rolls is supported are both rotated to combine a predetermined upper corrugating roll and a predetermined lower corrugating roll to produce a single-sided corrugated sheet with a different corrugation shape. In exchange, both the respective passageways for the core sheet and liner are not changed, so that it is unnecessary to cut away the core sheet and liner to cause the core sheet and liner to be re-introduced to thereby reduce a quantity of wasted sheet, shorten the time required for re-introducing a core sheet and a liner sheet, reduce the cost, and improve the working ratio of the machine. In addition, it is expected to automate the exchange of the corrugating rolls easily.

What is claimed is

1. A single facer comprising a set of upper corrugating rolls and a set of lower corrugating rolls, each set having a plurality of corrugating rolls with corrugations thereon for forming corrugations on a core sheet fed between one of the upper corrugating rolls and one of the lower corrugating rolls, means for pasting the core sheet at the tops of the corrugations, a means for feeding a liner between said one lower corrugating roll and a pressure roll for pasting the core sheet with the liner to thereby form a single-sided corrugated sheet, and separate rotatable frames supporting the upper set of corrugating rolls and lower set of corrugating rolls so that one of the corrugating rolls from the upper set and one of the corrugating rolls from the lower set are arranged to be engageable with each other to form a corrugation forming unit, wherein each corrugating roll from said upper set has a different corrugation thereon and each corrugating roll from said lower set has a different corrugation thereon.

2. A single facer of claim 1, wherein the separate frames have central shafts which in turn have at one end corresponding gears which mesh with each other and are equal in number of teeth.

3. A single facer of claim 1, further including means for retracting the pressure roll cooperating with said one lower corrugating roll and for retracting said pasting means when the frames are rotated.

4. A single facer of claim 1, further including pressure applying means for applying a pressure to said one upper corrugating roll and means for retracting said pressure applying means when the frames are rotated.

* * * * *